US011464277B2

(12) United States Patent
Nachmani

(10) Patent No.: US 11,464,277 B2
(45) Date of Patent: Oct. 11, 2022

(54) SHOE ACCESSORY TRACTION DEVICE

(71) Applicant: Minimal Gear LLC, Portland, OR (US)

(72) Inventor: Gilad Frank Nachmani, Portland, OR (US)

(73) Assignee: Minimal Gear LLC, Portland, OR (US)

( * ) Notice: Subject to any disclaimer, the term of this patent is extended or adjusted under 35 U.S.C. 154(b) by 99 days.

(21) Appl. No.: 17/046,158

(22) PCT Filed: Apr. 22, 2019

(86) PCT No.: PCT/US2019/028573
§ 371 (c)(1),
(2) Date: Oct. 8, 2020

(87) PCT Pub. No.: WO2019/204825
PCT Pub. Date: Oct. 24, 2019

(65) Prior Publication Data

US 2021/0037910 A1 Feb. 11, 2021

Related U.S. Application Data

(60) Provisional application No. 62/660,786, filed on Apr. 20, 2018.

(51) Int. Cl.
*A43B 5/18* (2006.01)
*A43C 15/02* (2006.01)

(52) U.S. Cl.
CPC ..... *A43B 5/185* (2013.01); *A43B 5/18* (2013.01); *A43C 15/02* (2013.01)

(58) Field of Classification Search
CPC .. A43B 5/185; A43B 5/18; A43B 4/16; A43B 4/18; A43B 3/16; A43B 3/18; A43C 15/02; A43C 15/06; A43C 15/061; A43C 15/065; A43C 15/066; A43C 15/068
See application file for complete search history.

(56) References Cited

U.S. PATENT DOCUMENTS 442,003 A * 12/1890 Armstrong ..... A43C 15/06 36/7.6
2,746,174 A * 5/1956 Patterson, Jr. ..... A43B 5/18 36/7.7
5,469,644 A 11/1995 Vidler
5,638,614 A * 6/1997 Hardy ..... A43B 3/16 36/7.1 R
5,689,901 A * 11/1997 Bell ..... A43B 5/18 36/62
5,836,090 A * 11/1998 Smith ..... A43B 3/16 36/15

(Continued)

OTHER PUBLICATIONS

International Search Report and Written Opinion for PCT/US2019/028573, dated Aug. 16, 2019.

(Continued)

*Primary Examiner* — Ted Kavanaugh
(74) *Attorney, Agent, or Firm* — Klarquist Sparkman, LLP

(57) ABSTRACT

An apparatus can comprise a main body configured to cover a portion of a lower side of a shoe, a plurality of cleats extending from a lower side of the main body, and at least one strap coupled to the main body and configured to extend over a shoe.

5 Claims, 3 Drawing Sheets

(56) References Cited

U.S. PATENT DOCUMENTS

| | | | | |
|---|---|---|---|---|
| 5,901,471 | A * | 5/1999 | Warner | A43C 15/068 36/125 |
| 7,222,440 | B2 | 5/2007 | Dombowsky | |
| 8,250,779 | B2 * | 8/2012 | Bell | A43C 15/02 36/7.1 R |
| 8,256,140 | B2 | 9/2012 | Lagrand et al. | |
| 8,839,529 | B1 | 9/2014 | Levy | |
| 2003/0226281 | A1 * | 12/2003 | Carlton | A43B 3/16 36/7.6 |
| 2003/0230006 | A1 * | 12/2003 | Dombowsky | A43B 13/187 36/7.6 |
| 2003/0230007 | A1 * | 12/2003 | Walton | A43B 13/36 36/15 |
| 2005/0193588 | A1 * | 9/2005 | Dombowsky | A43C 15/02 36/7.5 |
| 2009/0049711 | A1 * | 2/2009 | Finch | A43B 1/0036 36/7.1 R |
| 2010/0251562 | A1 * | 10/2010 | Barrick | A43B 3/16 36/7.6 |
| 2013/0263477 | A1 | 10/2013 | Girard et al. | |
| 2015/0230561 | A1 * | 8/2015 | Bunch | A43C 15/066 36/59 C |
| 2019/0208857 | A1 * | 7/2019 | Constantine | A43B 3/12 |

OTHER PUBLICATIONS

Examination Report for Australian Application No. 2019256731, dated Jun. 4, 2021.

* cited by examiner

SHOE ACCESSORY TRACTION DEVICE

CROSS REFERENCE TO RELATED APPLICATIONS

This is the U.S. National Stage of International Application No. PCT/US2019/028573, filed Apr. 22, 2019, which was published in English under POT Article 21(2), which in turn claims the benefit of U.S. Provisional Application No. 62/660,786, filed Apr. 20, 2018. The provisional application is incorporated herein in its entirety.

FIELD

The present disclosure relates generally to footwear accessories and particularly to a shoe accessory traction device.

BACKGROUND

Hiking and other outdoor activities often involving traversing various types of terrain. Different types of terrain can be often be best traversed with various different types of footwear situated for a particular terrain. There exists a need for footwear geared for muddy conditions.

SUMMARY

Embodiments of a shoe accessory are disclosed that are ideal for traversing muddy conditions.

In one representative embodiment, an apparatus can comprise a main body configured to cover a portion of a lower side of a shoe, a plurality of cleats extending from a lower side of the main body, and at least one strap coupled to the main body and configured to extend over a shoe.

In some embodiments, the main body can comprise a rubber material. In some embodiments, the main body can comprise Vibram rubber. In some embodiments, the cleats can comprise a rubber material. In some embodiments, the cleats can comprise Vibram rubber.

In some embodiments, the apparatus can further comprise a right side portion connected to a right side of the main body, a left side portion connected to a left side of the main body, a front portion connected to a front portion of the main body, and a rear portion connected to a rear portion of the main body.

In some embodiments, the right side portion, the left side portion, the front portion, and the rear portion can comprise polyurethane. In some embodiments, the right side portion, the left side portion, the front portion, and the rear portion can be sewn to the main body.

In some embodiments, the strap can comprise a magnetic strap. In some embodiments, the strap can comprise a Velcro strap.

In some embodiments, the apparatus can further comprise a first side strap coupled to the right side portion and the rear portion and a second side strap coupled to the left side portion and the rear portion. In some embodiments, the first side strap and the second side strap can comprise a ladder slide. In some embodiments, the first side strap and the second side strap can comprise a nylon material.

In some embodiments, the right side portion can comprise a first opening and the left side portion can comprise a second opening. In some embodiments, the first side strap can extend through the first opening and the second side strap can extend through the second opening.

In some embodiments, the plurality of cleats can comprise a plurality of outer cleats extending around an outer portion of the main body and a plurality of inner cleats extending around an inner portion of the main body.

In some embodiments, a height of the outer cleats can be greater than a height of the inner cleats. In some embodiments, the outer cleats can have a height of between 7 mm and 10 mm. In some embodiments, the inner cleats can have a height of between 4 mm and 6 mm.

The foregoing and other objects, features, and advantages of the invention will become more apparent from the following detailed description, which proceeds with reference to the accompanying figures.

DETAILED DESCRIPTION

Figure 1:
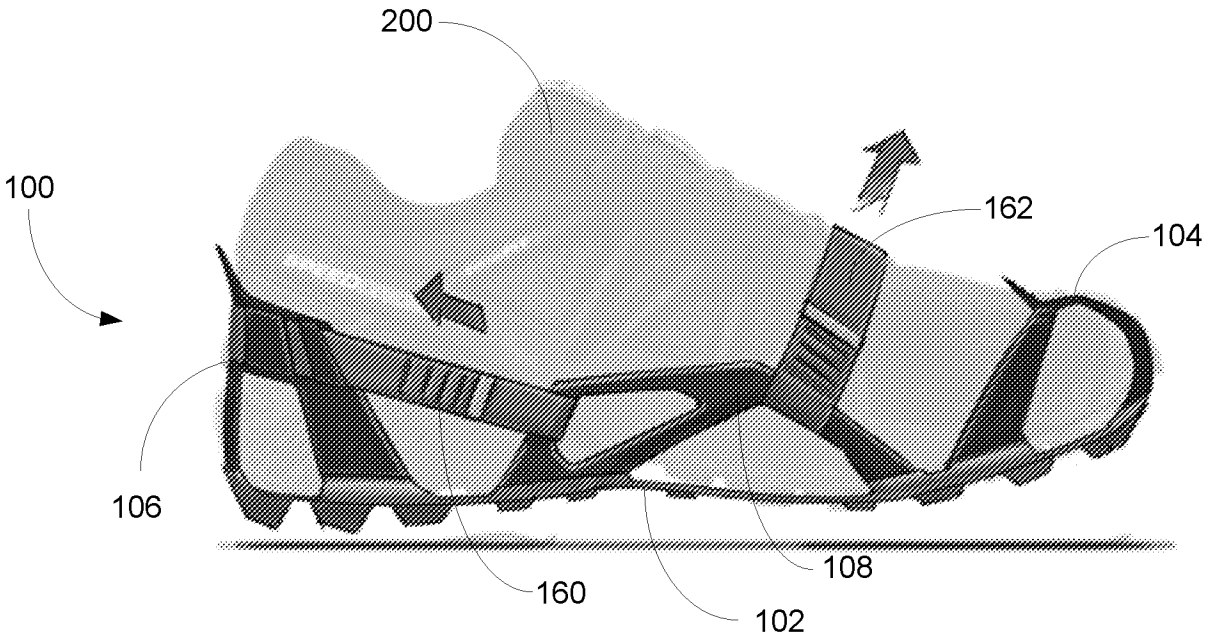
FIG. 1 shows a side view of an exemplary embodiment of a shoe accessory device.
Figure 2:
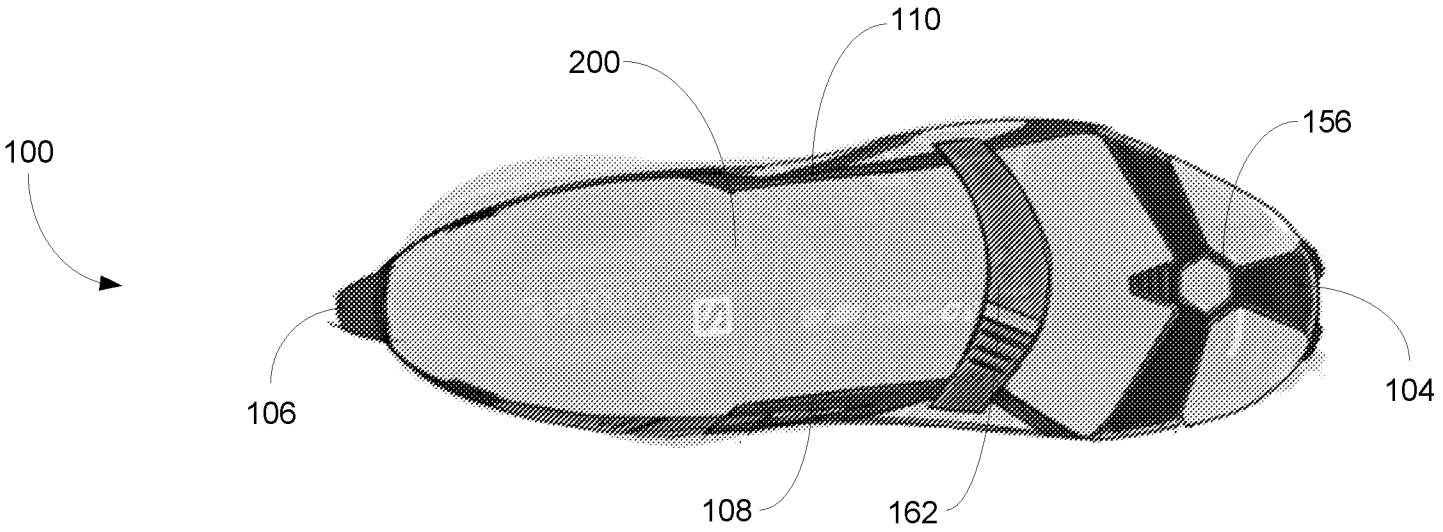
FIG. 2 shows a top view of an exemplary embodiment of a shoe accessory device.
Figure 3:
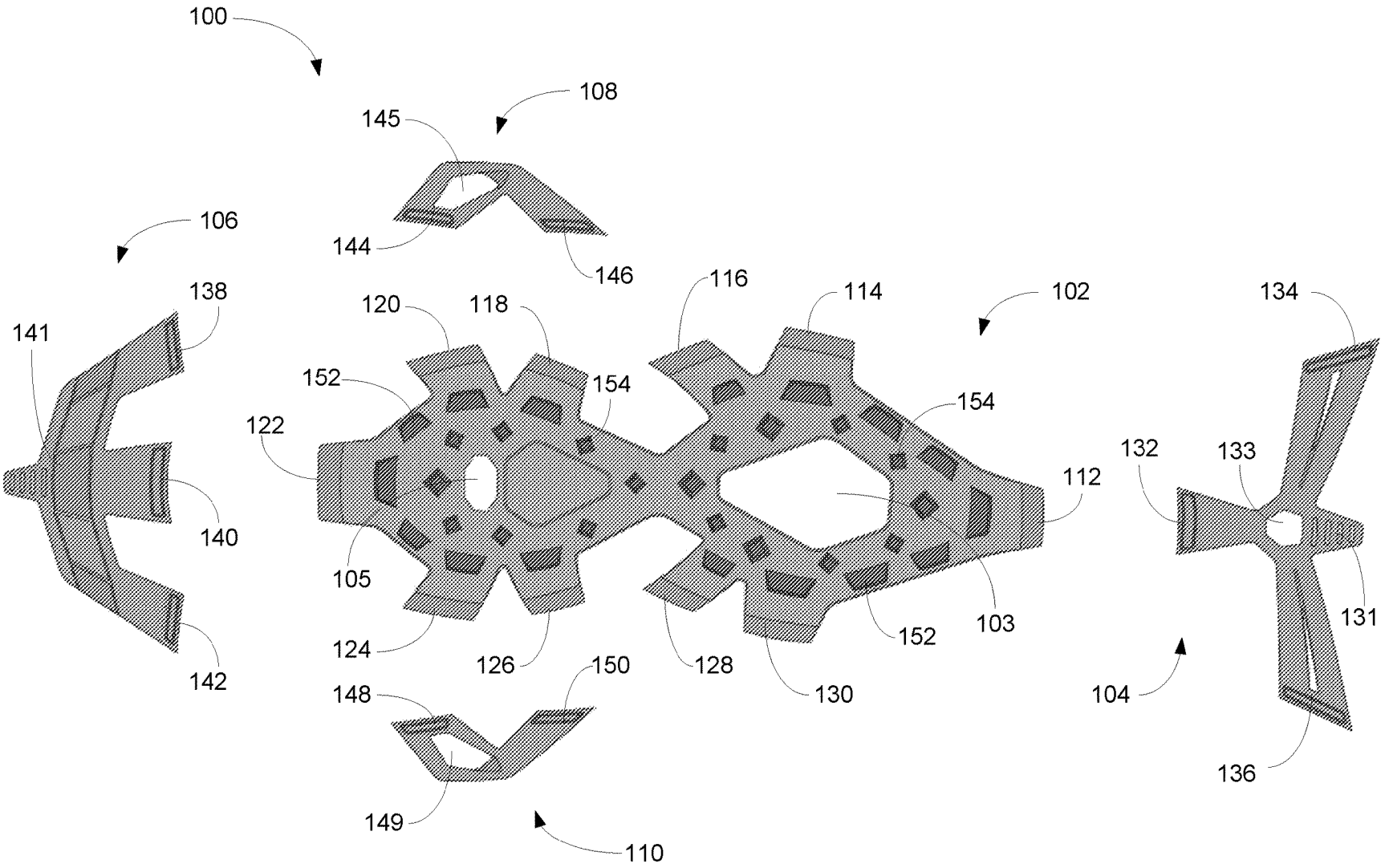
FIG. 3 shows an exploded view of an exemplary embodiment of a shoe accessory device.

FIGS. 1-3 show various views of an embodiment of a shoe accessory device 100. The device 100 can be worn over a shoe to increase traction of the shoe in muddy conditions or mixed trails. Additionally, the device 100 can be quickly and easily put on over a shoe or removed from a shoe. This can allow an individual to more easily traverse various terrains, wearing the device over their shoes when helpful and removing it when not.

In the illustrated embodiment, the device 100 comprises a main body 102, a front portion 104, a rear portion 106, a right side portion 108, and a left side portion 110, as shown in FIG. 3. In the illustrated embodiment, the main body 102 comprises openings 103 and 105. In other embodiments, the main body can contain additional openings, fewer openings, or no openings. In the illustrated embodiment, the main body 102 comprises a rubber material. In some examples, the main body 102 comprises Vibram rubber. In other examples, the main body 102 can comprise other types of rubber. In the illustrated embodiment, the main body 102 is flexible and able to stretch. In the illustrated embodiment, the front, rear, right side, and left side portions 104, 106, 108, 110 comprise high density thermoplastic polyurethane (TPU) material. In other examples, the portions 104, 106, 108, 110 can comprise other types of flexible material.

The main body 102 can be sized and shaped to substantially cover the bottom of a shoe. The main body 102 has a series of connector portions 112, 114, 116, 118, 120, 122, 124, 126, 128, and 130 that can be connected to the front, rear, right side, and left side portions 104, 106, 108, 110, as described herein. In the illustrated embodiment, the portions 104, 106, 108, 110 can be sewn to the connector portions of the main body 102. In other examples, the portions 104, 106, 108, 110 can be affixed to the main body by other means during manufacturing.

The front portion 104 is Y-shaped with arms 132, 134, 136 extending outward from a central portion 131, and forming an opening 133, as shown in FIG. 3. During manufacturing, arm 132 can be connected to connector portion 112, arm 134 can be sewn to connector portion 114, and arm 136 can be sewn to connector portion 130.

The right side portion 108 is arch-shaped and comprises arms 144 and 146 and opening 145. During manufacturing, arm 144 can be sewn to connector portion 118 and arm 146 can be sewn to connector portion 116. The left side portion 110 is a mirror image of the right side portion 108 and comprises arms 148 and 150 and opening 149. During manufacturing, arm 148 can be sewn to connector portion 126 and arm 150 can be sewn to connector portion 128.

The rear portion is M-shaped and comprises arms 138, 140, and 142 extending from main body 141. During manufacturing, arm 140 can be sewn to connector portion 122, arm 138 can be sewn to connector portion 120, and arm 142 can be sewn to connector portion 124.

A plurality of outer cleats 152 and inner cleats 154 can extend from a lower portion of the main body 102. The cleats 152, 154 can be made of rubber or other suitable material. In the illustrated embodiment, the outer cleats 152 are positioned around an outer portion of the main body 102 and the inner cleats 154 are positioned around an inner portion of the main body 102. In other embodiments, the cleats 152, 154 can be positioned in other arrangements along the lower portion of the main body 102. In the illustrated embodiment, there are 16 outer cleats 152 and 18 inner cleats 154 as shown in FIG. 3. In other embodiments, the main body 102 can comprise any number of cleats.

The outer cleats 152 can have a height extending from the main body of between 7-10 mm, and in particular embodiments can have a height of 8 mm. The inner cleats 154 can have a height extending from the main body of between 4-6 mm, and in particular embodiments can have a height of 5 mm. In some embodiments, the heights of the outer cleats 152 can be greater than the height of the inner cleats 154. In other embodiments, the height of the outer cleats 152 can be the same as the height of the inner cleats 154. When the device 100 is worn around a shoe, the cleats 152, 154 can help establish or increase traction in conditions that are wet, muddy, or otherwise difficult to walk in in normal shoes. The ends of the cleats can be sticky to help increase traction on web surfaces such as rock Referring to FIG. 1, when the device 100 is worn around a shoe 200, the front, rear, right, and left portions 102, 104, 106, 108 can be folded around the shoe and a plurality of straps can be used to hold the device 100 in place around the shoe. A right strap 160 can coupled to and can extend between the right side portion 108 and the rear portion 106 along the right side of the shoe 200. A left strap (not shown) can be the same as the right strap 160 and be coupled to and extend between the left side portion 110 and the rear portion 106. In the illustrated embodiment, the right strap 160 can extend through the opening 145 and the left strap can extend through the opening 149. A top strap 162 can extend over the top of the shoe 200 and can be coupled to the right side portion 108 and the left side portion 110. In the illustrated embodiment, the straps comprise a nylon weave material. In other embodiments, the straps can comprise any other suitable material.

The right strap 160 and the left strap can stay in place as they do not need to be disconnected. The right strap and the left strap can be an adjustable ladder slide design. In other embodiments, the right strap and the left strap can comprise another type of strap suitable for holding the device 100 in place around a shoe. In the illustrated embodiment, the right and left strap can be adjusted to fit shoes of different sizes.

The top strap 162 can be disconnected to put the device 100 on or take the device off and can be connected once the device is positioned around a shoe to hold it in place. The top strap 162 can be magnetic, Velcro, a ladder slide, a clip, or other types of straps that can be easily strapped together and unstrapped by a user.

The shoe accessory device 100 can be worn over any type of shoe. The device 100 can be easily taken off or on a shoe as desired by a user. As such, as a hiker or other individual encounters different types of terrain during a hike or other venture, the device 100 can be placed on or removed from the individual's shoes as needed. The device 100 can be manufactured in a variety of sizes to fit a variety of shoe sizes.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope of these claims.

I claim:

1. A sole cover for an article of footwear, comprising:

a main body configured to cover a portion of a lower side of a shoe, the main body comprising a toe portion, a heel portion, and a midfoot portion located between the toe portion and the heel portion;

a front portion attached to the toe portion of the main body, the front portion comprising a toe lock, a first arm, and a second arm, wherein the toe lock extends from the toe portion of the main body towards the midfoot portion of the main body is configured to extend over and secure at toe portion of the shoe to the toe portion of the sole cover when the sole cover is worn and wherein the first arm and the second arm of the front portion extend from the front portion to the main body;

a rear portion attached to the heel portion of the main body, the rear portion comprising a heel lock, a first arm, and a second arm, wherein the heel lock extends from the main body is configured to extend over and secure a heel portion of the shoe to the heel portion of the sole cover when the sole cover is worn and the first arm and the second arm of the rear portion extend forward from the heel lock to join the main body at a position forward of the heel lock;

a first side portion attached to a lateral side of the midfoot portion of the main body, the first side portion comprising a first aperture and a second aperture;

a second side portion attached to a medial side of the midfoot portion of the main body, the first side portion comprising a first aperture and a second aperture;

a first adjustable heel strap extending from the rear portion to the first aperture of the first side portion;

a second adjustable heel strap extending from the rear portion to the first aperture of the second side portion;

a second adjustable strap extending from the second aperture of the first side portion to the second aperture of the second side portion; and a plurality of cleats extending from a lower side of the main body.

2. The sole cover of claim 1, wherein the first adjustable heel strap and the second adjustable heel strap are integrally formed and extend over the heel lock of the rear portion.

3. The sole cover of claim 1, wherein the toe portion comprises an opening configured to expose a portion of a sole of the shoe when the sole cover is worn over the shoe.

4. The sole cover of claim 1, wherein the heel portion comprises an opening configured to expose a portion of a sole of the shoe when the sole cover is worn over the shoe.

5. The sole cover of claim 1, wherein the toe portion comprises a first opening and the heel portion comprises a second opening, wherein the first opening and the second opening are configured to partially expose a portion of a sole of the shoe when the sole cover is worn over the shoe.

* * * * *